US012808594B2

(12) United States Patent
Van Beek et al.

(10) Patent No.: US 12,808,594 B2
(45) Date of Patent: Nov. 24, 2026

(54) HYBRID COOLER ARRANGEMENT

(71) Applicant: Thetford BV, Etten-Leur (NL)

(72) Inventors: Jacco Van Beek, Breda (NL); Lennart Jansen, Etten-Leur (NL)

(73) Assignee: Thetford BV, Etten-Leur (NL)

( * ) Notice: Subject to any disclaimer, the term of this patent is extended or adjusted under 35 U.S.C. 154(b) by 139 days.

(21) Appl. No.: 18/785,168

(22) Filed: Jul. 26, 2024

(65) Prior Publication Data

US 2025/0052478 A1 Feb. 13, 2025

Related U.S. Application Data

(60) Provisional application No. 63/531,892, filed on Aug. 10, 2023.

(51) Int. Cl.
*F25D 19/00* (2006.01)
*F25D 11/00* (2006.01)

(52) U.S. Cl.
CPC ..... *F25D 19/003* (2013.01); *F25D 11/003* (2013.01); *F25D 2300/00* (2013.01); *F25D 2323/06* (2013.01); *F25D 2331/804* (2013.01); *F25D 2400/12* (2013.01)

(58) Field of Classification Search
CPC .. F25D 19/003; F25D 11/003; F25D 2300/00; F25D 2323/06; F25D 2331/804; F25D 2400/12
See application file for complete search history.

(56) References Cited

U.S. PATENT DOCUMENTS

| | | | | |
|---|---|---|---|---|
| 3,505,830 | A | 4/1970 | Koerner | |
| 5,111,664 | A | 5/1992 | Yang | |
| 2011/0082437 | A1* | 4/2011 | Stacey | F25D 15/00 604/404 |
| 2020/0071076 | A1 | 3/2020 | Fosnight et al. | |
| 2021/0131716 | A1 | 5/2021 | Zhao et al. | |
| 2024/0102718 | A1* | 3/2024 | Kishima | F25D 31/005 |

FOREIGN PATENT DOCUMENTS

| | | | |
|---|---|---|---|
| JP | 2006010183 | A | 1/2006 |
| KR | 100503888 | B1 | 7/2005 |

OTHER PUBLICATIONS

Extended European Search Report Corresponding to European Application No. 241920230, dated Jan. 3, 2025.

* cited by examiner

*Primary Examiner* — Elizabeth J Martin
(74) *Attorney, Agent, or Firm* — Harness, Dickey & Pierce, P.L.C.; Stephen T. Olson

(57) ABSTRACT

A hybrid cooler arrangement includes a portable cooler and a cooling system. The portable cooler has an insulated chamber. The cooling system is operative for cooling the portable cooler. The portable cooler is removably attachable to the cooling system.

9 Claims, 5 Drawing Sheets

HYBRID COOLER ARRANGEMENT

CROSS-REFERENCE TO RELATED APPLICATIONS

This application claims the benefit of U.S. Provisional Application No. 63/531,892, filed on Aug. 10, 2023. The entire disclosure of the above application is incorporated herein by reference.

FIELD

The present disclosure relates generally to coolers and, more particularly, to a hybrid cooler arrangement including a cooling system and a detachable, portable cooler.

BACKGROUND

This section merely provides background information related to the present disclosure and may not constitute prior art.

Vehicles, including but not limited to, recreational vehicles ("RVs", in the United States and "Caravans" in Europe), tractor trailers, airplanes, boats, trains and the like, often incorporate refrigerators for the comfort and convenience of the occupants. For example, recreational vehicle campers may be equipped with a refrigerator to be used for the cooling of food, drinks, and medicine during a journey and while at campsites.

It is also generally known to equip these types of vehicles with a cooler or coolbox. While known passive coolers and known active coolers may have proven to be generally suitable for their intended purposes, known devices are all associated with limitations. In this regard, passive coolers rely on insulation to maintain cooling and must be occasionally filled with ice, cool packs or buffers (PCM), and the like. All these solution are heavy and necessarily occupy usable volume from the cooler. Coolers with active cooling are also heavy, and often too heavy to be used for remote activities.

Accordingly, there remains an existing need in the relevant art for a hybrid cooler arrangement that can be used both passively and actively.

SUMMARY

This section provides a general summary of the disclosure, and is not a comprehensive disclosure of its full scope or all of its features.

It is a general goal of the present teachings to provide a hybrid cooler arrangement combining the functionality of a passive cooler and an active cooler.

According to one particular aspect, the present teachings provide a hybrid cooler arrangement including a portable cooler and a cooling system. The portable cooler has an insulated chamber. The cooling system is operative for charging the portable cooler. The portable cooler is removably attachable to the cooling system.

Further areas of applicability will become apparent from the description provided herein. The description and specific examples in this summary are intended for purposes of illustration only and are not intended to limit the scope of the present disclosure.

DRAWINGS

The present teachings will become more fully understood from the detailed description, any appended claims and the following drawings. The drawings are for illustrative purposes only and are not intended to limit the scope of the present disclosure.

DETAILED DESCRIPTION

Figure 1:
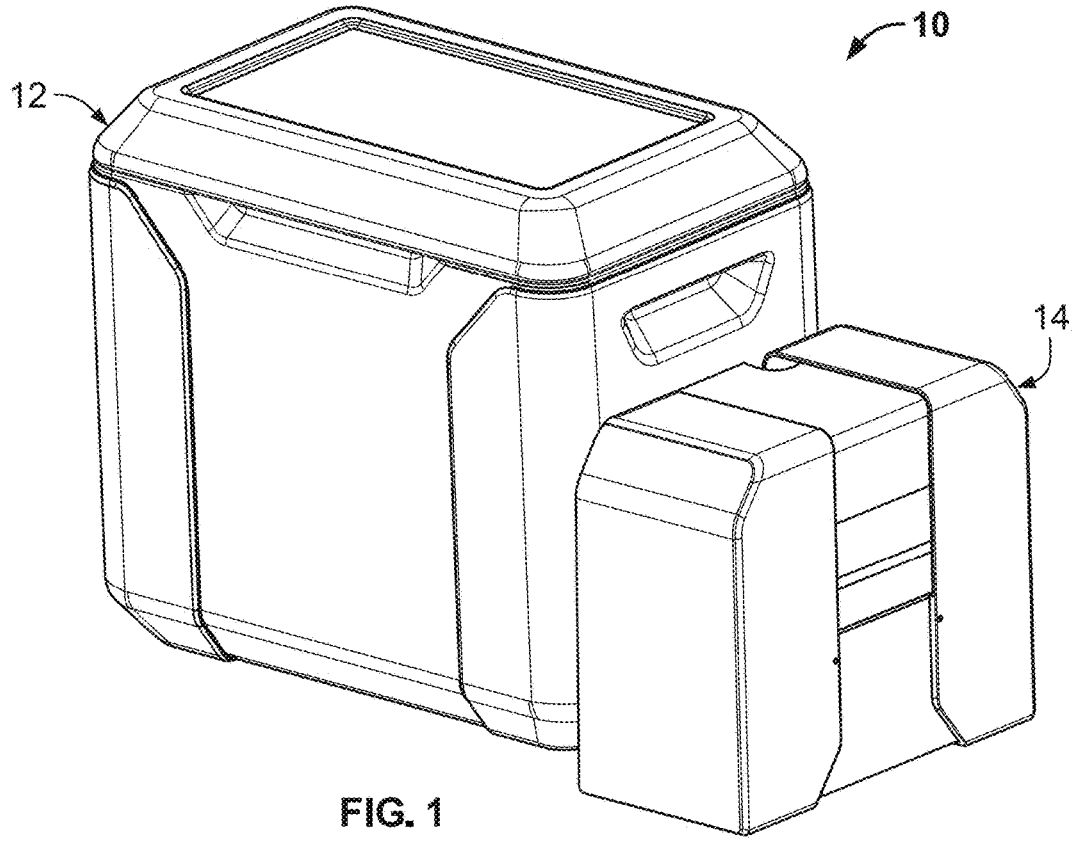
FIG. 1 is a perspective view of a hybrid cooler arrangement constructed in accordance with the present teachings, the hybrid cooler arrangement generally including a portable cooler and a cooling system.
Figure 2:
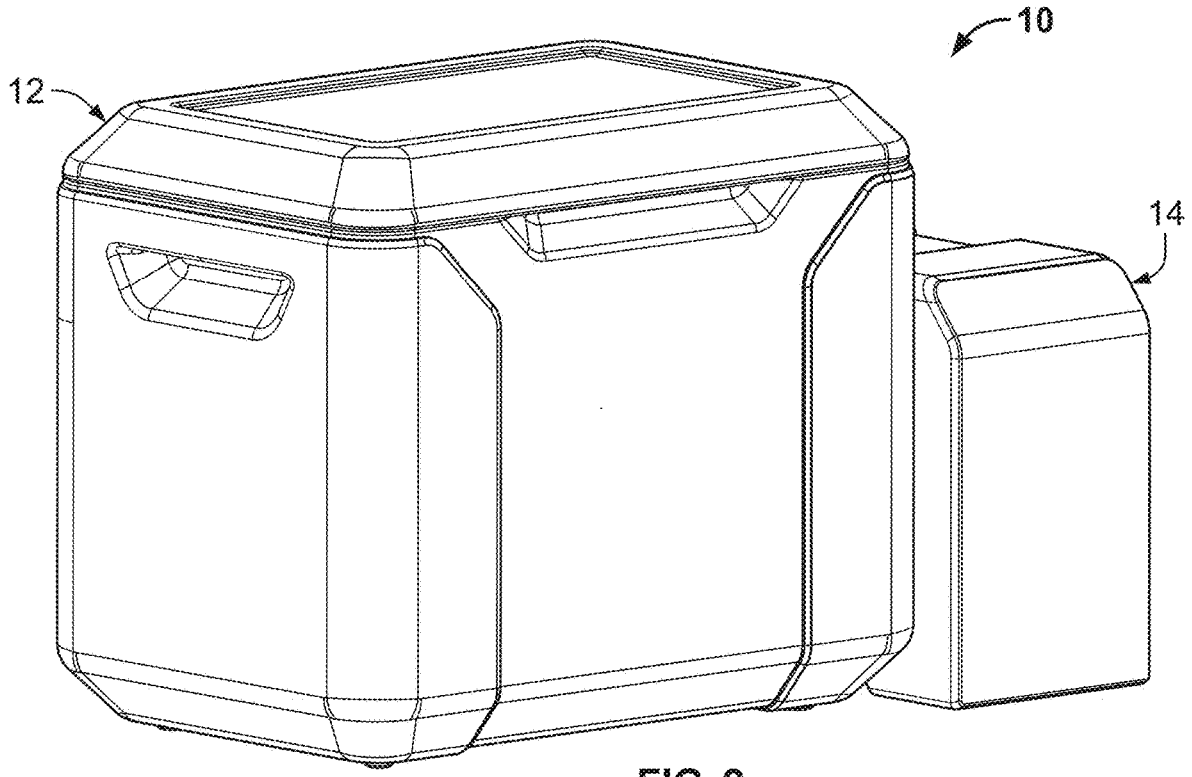
FIG. 2 is another perspective view of the hybrid cooler arrangement of FIG. 1.

The following description is merely exemplary in nature and is not intended to limit the present disclosure, its application, or uses. It will be understood that throughout the drawings, corresponding reference numerals indicate like or corresponding parts and features.

With reference to FIGS. 1 through 7 the drawings, a hybrid cooler arrangement constructed in accordance with the present teachings constructed in accordance with the present teachings is shown and generally identified at reference character 10. The hybrid cooler arrangement 10 is illustrated to generally include a cooler 12 (also known as a coolbox) and a cooling system 14. As will be appreciated more fully below, the cooler 12 is removably attachable to the cooling system 14 for charging of the cooler 12. As used herein, the term "charging" shall be understood to mean cooling of the internal temperature of the cooler 12.

The cooler 12 of the present teachings is a portable cooler. The cooler 12 is designed to be lightweight for easy transportation from a vehicle or home to a remote location. In this regard, the cooler 12 provides functionality similar to passive coolers designed to maintain a lower temperature (as compared to ambient temperatures) of goods within the cooler with insulative properties of the cooler.

To the extent not otherwise described herein, the cooler 12 will be understood to be conventionally constructed of known materials. The cooler 12 defines an inner compartment or cooling compartment 16 for the storage of goods, and includes an outer shell 19 and a hygienic liner insulation, which can be made of standard insulation materials but can also be of insulative vacuum panels 20. The cooler 12 further includes a lid 22 for providing access to the cooling compartment 16.

One wall 24 of the cooler 12 is cooperatively configured with the cooling system 14 to removably couple with cooling system 14. In the embodiment illustrated, the wall that is adapted to cooperate with the cooling system 14 is a first side wall 24. As illustrated, the first side wall 24 is one of the short walls of the rectangular cooler 12. It will be understood, however, that a long wall of the rectangular cooler 12 or a bottom wall of the cooler 12 may alternatively be used within the scope of the present teachings. Insofar as the scope of the present teachings are concerned, the cooling system 14 and the cooler 10 may be cooperatively configured in various manners such that any surface of the cooler 12 may be utilized for docking with the cooling system 14.

Figure 3:
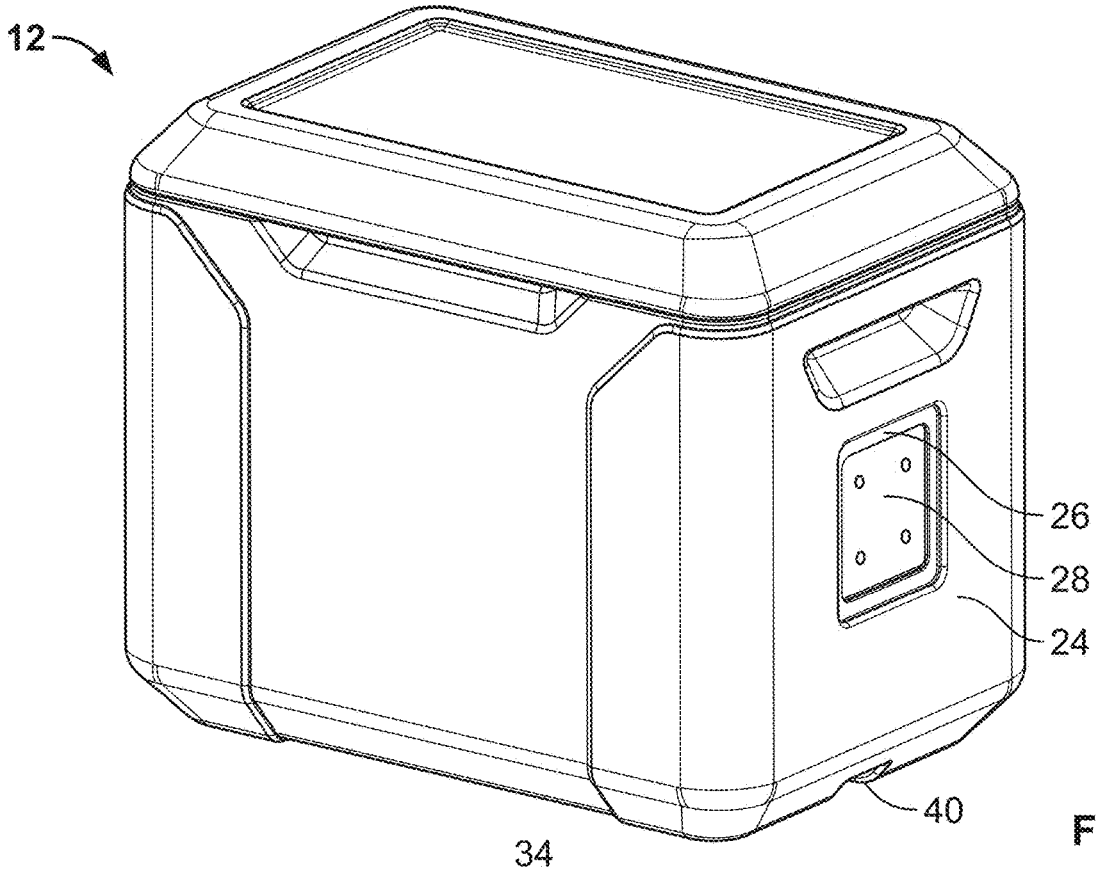
FIG. 3 is a perspective view of the portable cooler of the hybrid cooler arrangement of FIG. 1.
Figure 4:
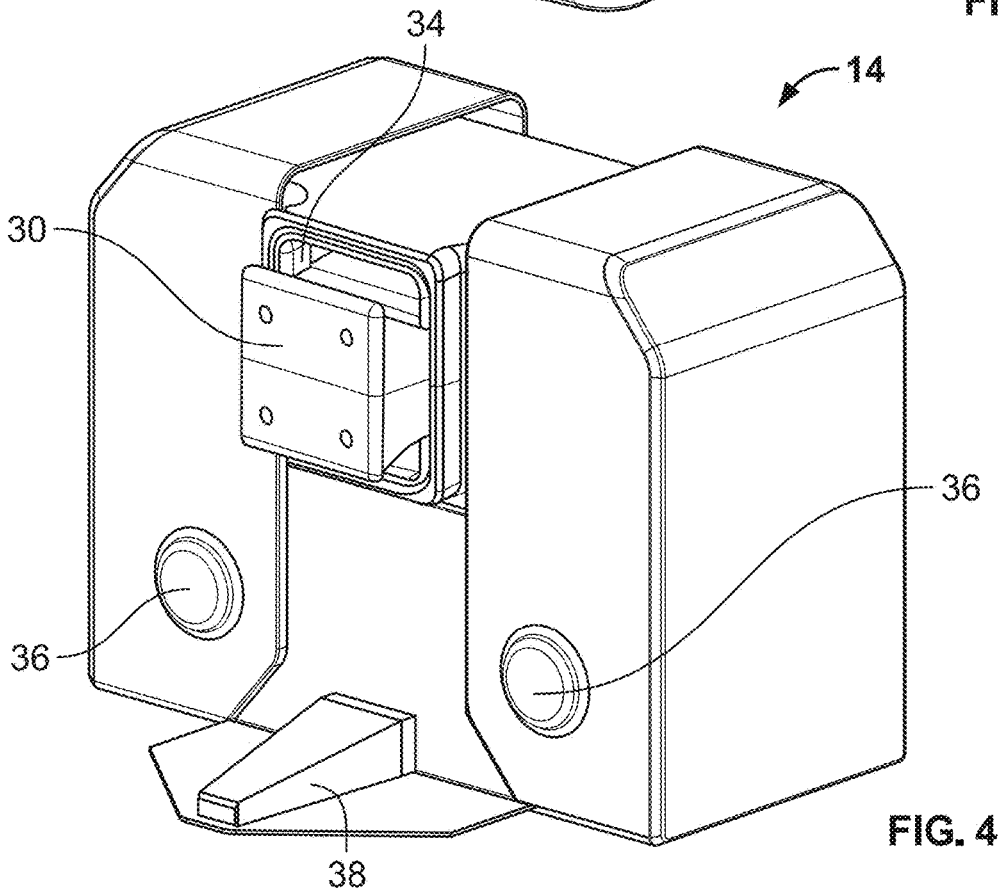
FIG. 4 is a perspective view of the cooling system of the hybrid cooler arrangement of FIG. 1.
Figure 5:
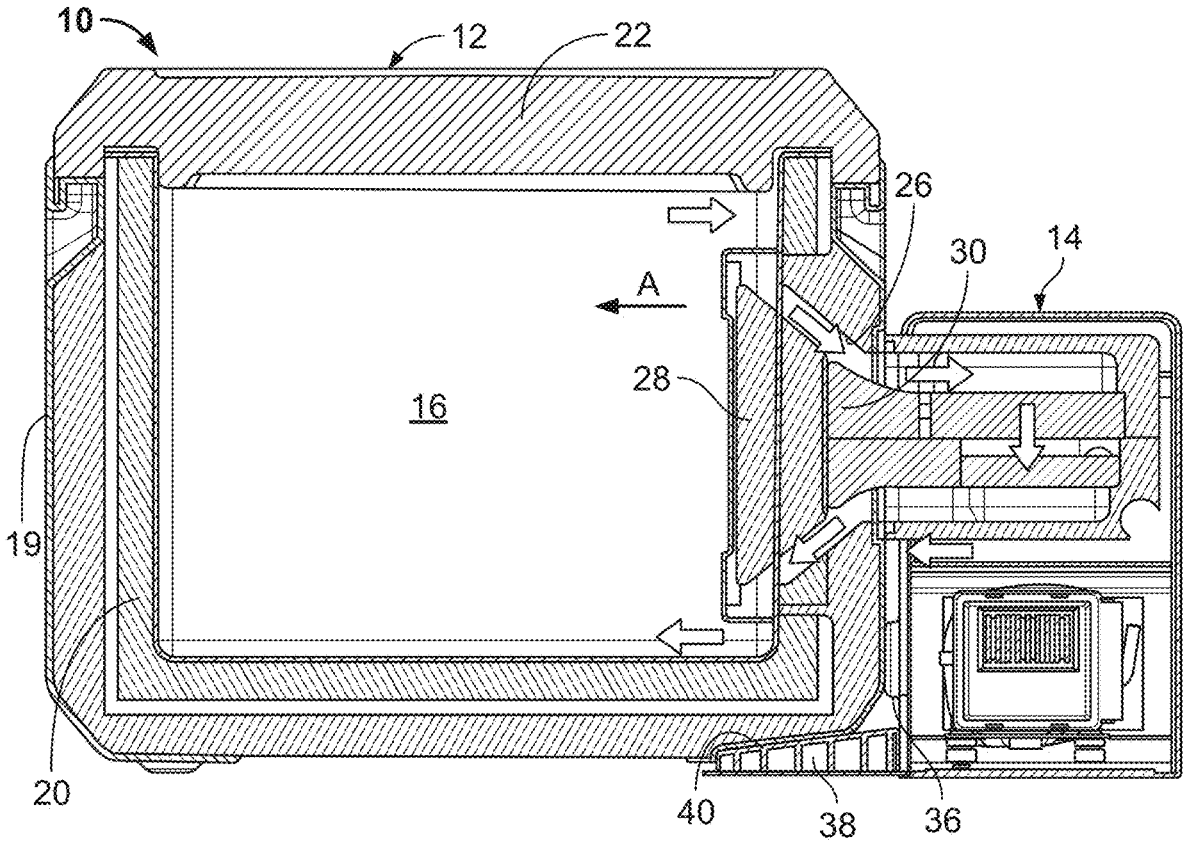
FIG. 5 is a cross-sectional view of the hybrid cooler arrangement of FIG. 1, illustrating a plug member of the cooler in a second or open position and showing the cooling airflow generated by the cooling system and delivered to the portable cooler.
Figure 5A:
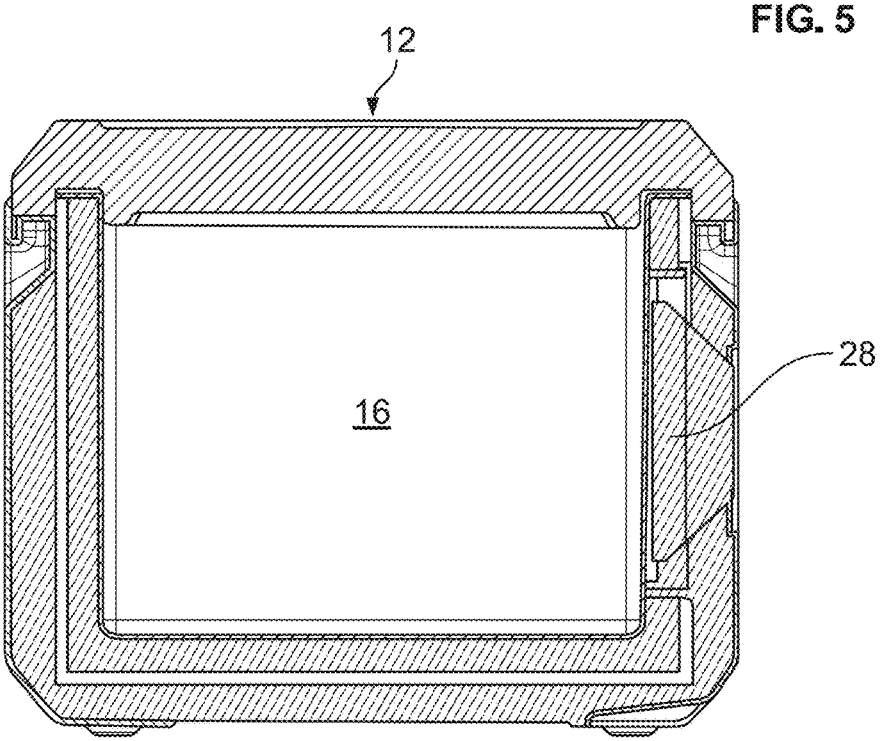
FIG. 5A is a cross-section view similar to FIG. 5, illustrating the cooler and showing the plug member in a first or open position.
Figure 6:
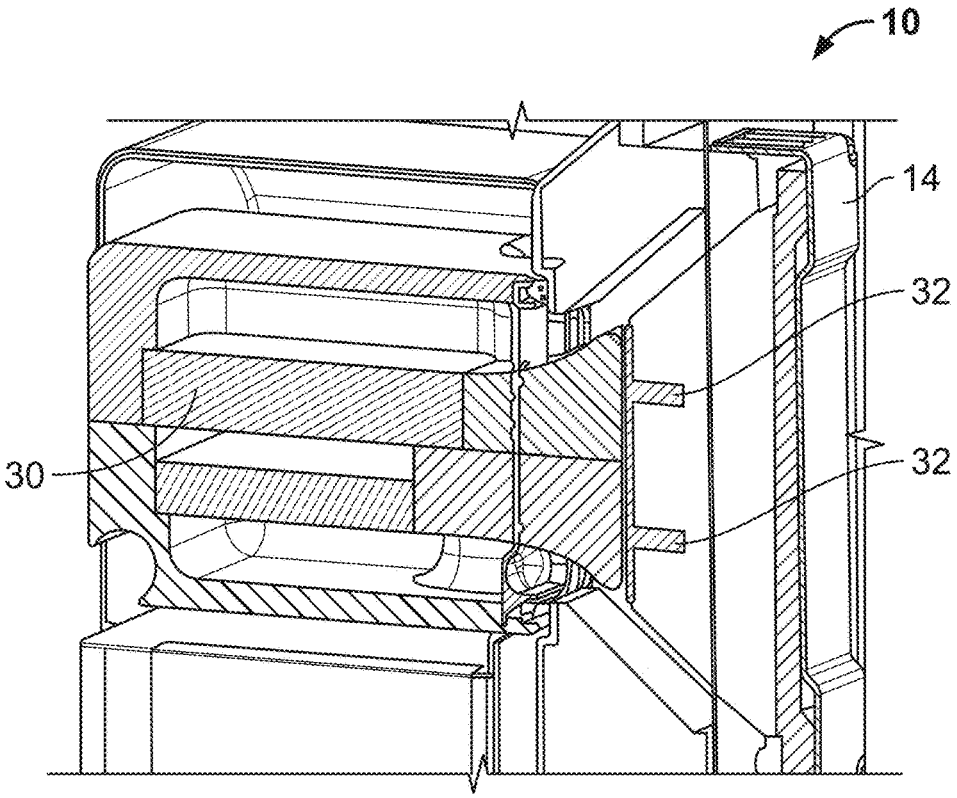
FIG. 6 is another cross-sectional view of a portion the hybrid cooler arrangement of FIG. 1, illustrating a sealing arrangement between the cooling system and the portable cooler.
Figure 7:
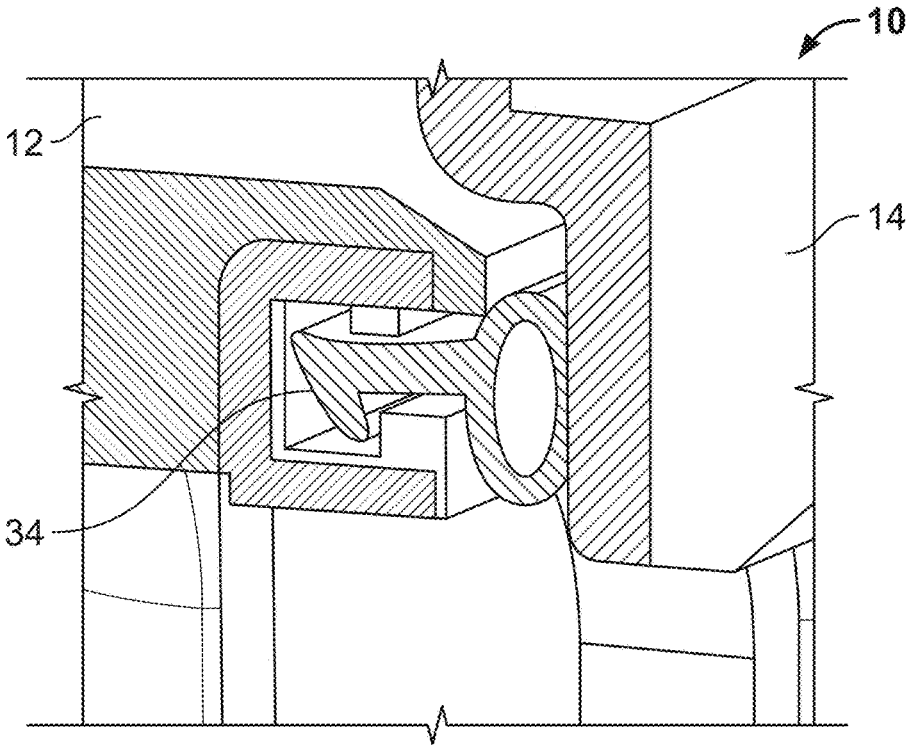
FIG. 7 is an enlarged view of a portion of the cross-sectional view of FIG. 6, further illustrating a sealing arrangement between the cooling system and the portable cooler.

The first side wall 24 defines an opening 26 for receiving a portion of the cooling system 14. The opening 26 in the first side wall 24 may be rectangular (as shown) or of any other suitable shape to interface with the cooling system 14. In certain applications, multiple openings may be provided. When the cooler 12 is not coupled with the cooling system 14, the opening 26 in the first side wall 24 is closed by a plug member 28 (as shown in FIGS. 3 and 5A, for example). The plug member 28 is moveable in an inward direction arrow A (see FIG. 5) from a first or closed position to a second or open position (as shown in FIG. 5, for example). In the closed position, the plug member 28 seals the cooling compartment 16 to maximize the insulative properties of the cooler 12. As shown, the plug member 28 may be a tapered plug member 28. While the tapered shape of the plug member 28 requires limited movement and minimal restrictions of the space/volume of the compartment 16, other shapes may be utilized within the scope of the present teachings. The plug member 28 allows the cooling system 14 to circulate air out of the cooler 12 through a heat exchanger 14*a* of the cooling system 14. In this regard, air of the cooler 12 may be continuously circulated over the heat exchanger 14*a* and an evaporator, which brings the temperature incrementally down towards an intended temperature.

The cooling system 14 conventionally includes the evaporator for generating a source of cooling air and a fan for distributing the source of cooling air to the cooling compartment 16 of the cooler 12. The cooling system 14 is shown to further include a male extension 30. The male extension 30 is sized to fit in the opening 26 of the first side wall 24 to push the plug member 28 from the first position to the second position and is configured to allow the cooling system 14 to circulate air out of the cooler 12 through the heat exchanger 14*a* of the cooling system 14. To facilitate this flow of air, the male extension 30 may be tapered, for example, to allow for the circulation of cooling air from the cooling unit 12, to the cooling compartment 16 of the cooler 12, and back to the cooling unit. As such, a construction is created that provides a channel for airflow.

The plug member 28 may be caught and held open by a set of magnets 32 or other suitable mechanism. When the cooler 12 is removed from the cooling system 14 (i.e., undocked from the cooling system 14, the plug member 28 may move back to the closed or insulating position under the force of a spring or by another other mechanism well known in the art.

A nose portion of the cooling system 14 may be provided with a seal 34. The seal 34 may operate to prevent the leakage of air between the cooler 12 and the cooling system 14. The cooling system 14 may include one or more magnets 36 for engaging the shell 18 of the cooler 12 to functionally hold the cooler 12 relative to the cooling system 14. In certain applications, it may be desired to add a further mechanical lock "driving lock" to secure the cooler 12 and the cooling system 14 during travel of a vehicle. The cooling system 14 may also include a tapered guide member 38. The tapered guide member 38 may extend from the remainder of the cooling system to engage a correspondingly shaped recess 40 in the cooler 12 to pre-position the cooler 12 relative to the cooling system 14 during docking.

Figure 8:
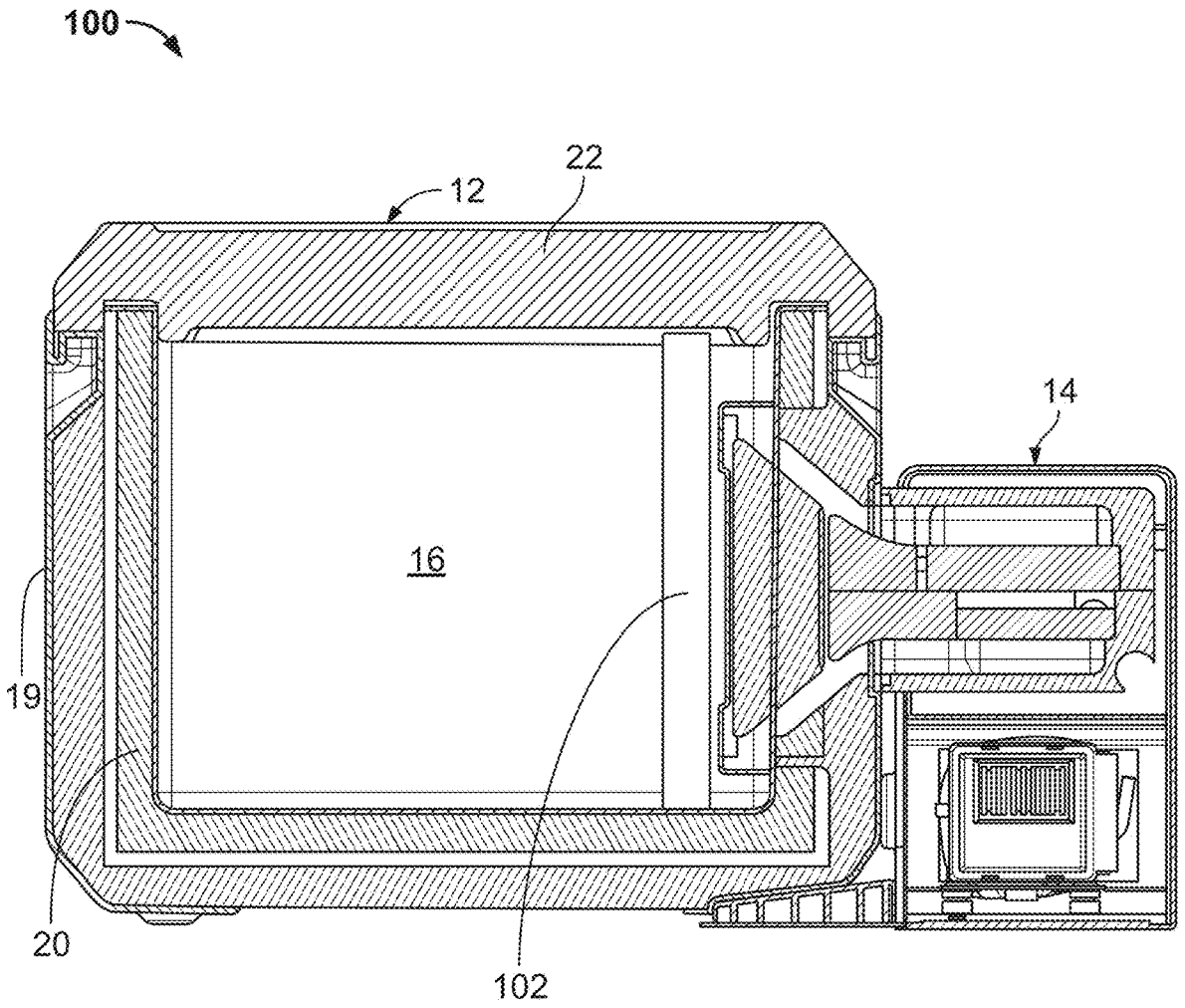
FIG. 8 is a cross-sectional view similar to FIG. 5, illustrating another hybrid cooler arrangement constructed in accordance with the present teachings.

Turning to the cross-sectional view of FIG. 8, another hybrid cooler arrangement constructed in accordance with the present teachings is illustrated and generally identified at reference character 100. Given the similarities between the hybrid cooler arrangement 10 and the hybrid cooler arrangement 100, like reference characters will be used to identity like element. The hybrid cooler arrangement 100 differs from the hybrid cooler arrangement 10 by additionally incorporating a phase change material (PCM) 102. The PCM 102 is provided in the cooling compartment 16. The cooling system 14 may be configured to recognize the presence of the PCM 102 and automatically switch to a freezing mode. By cooling down the PCM 102, the portable cooler 12 will have an increased charge life when used remotely from the cooling system 14. This dedicated PCM 102 may be cooled down without the use of a separate freezer.

While one or more specific examples have been discussed in the specification and illustrated in the drawings, it will be understood by those skilled in the art that various changes may be made and equivalence may be substituted for elements thereof without departing from the scope of the present teachings. For example, while the present teachings have been described in connection with a mobile compressor refrigerator, the invention is not so limited and may be extended to other applications. Moreover, many modifications may be made to adapt a particular situation or material to the present teachings without departing from the essential scope thereof. Therefore, it may be intended that the present teachings not be limited to the particular examples illustrated by the drawings and discussed in the specification as the best mode of presently contemplated for carrying out the present teachings but that the scope of the present disclosure will include any embodiments following within the foregoing description and any appended claims.

What is claimed is:

1. A hybrid cooler arrangement comprising:

a portable cooler having an insulated chamber configured for storing food items or beverages, wherein the insulated chamber comprises insulating foam material disposed between an outer shell and an inner shell, the outer shell having a side wall, wherein the portable cooler has a top opening with a hinged lid for user access to the insulated chamber, and wherein the portable cooler is configured for standalone use as a passively insulated consumer cooler when detached from a cooling system; and the cooling system comprising a heat exchanger disposed completely within the cooling system, which is structurally independent from and external to the portable cooler, wherein the cooling system is configured to generate cooled air for cooling the portable cooler by delivering cooled air into the insulated chamber through a docking connection formed at the side wall of the portable cooler, wherein the portable cooler is removably attachable to the cooling system by placement of the portable cooler onto a portion of the cooling system to form the docking connection; and wherein the docking connection comprises:

(i) a first opening formed in the side wall of the portable cooler;

(ii) a male extension projecting from the cooling system and sized to be received into the first opening when the portable cooler is placed onto the portion of the cooling system;

(ii) a plug member disposed within the first opening and movable to a closed position that seals the first opening when the portable cooler is detached from the cooling system; and (iv) wherein the male extension mechanically engages and displaces the plug member to an open position as the portable cooler is placed onto the portion of the cooling system, thereby automatically establishing an air flow path from the cooling system around the male extension and through the first opening into the insulated chamber, and wherein the plug member automatically returns to the closed position when the portable cooler is removed from the support surface.

2. The hybrid cooler arrangement of claim 1, wherein the first opening formed in the side wall is rectangular in shape.

3. The hybrid cooler arrangement of claim 1, wherein the male coupling extension is tapered with a wider base portion adjacent to the cooling system and a narrower distal end portion that initially enters the first opening, and wherein the first opening comprises a correspondingly tapered receptacle, the tapered configuration providing self-alignment of the portable cooler with the cooling system as the portable cooler is lowered onto the support surface.

4. The hybrid cooler arrangement according to claim 1, wherein the cooling system includes a tapered guide member forming part of the first male coupling extension or disposed adjacent to the male coupling extension on the support surface for engaging a correspondingly tapered shaped recess formed in the side wall of the portable cooler to pre-position the portable cooler relative to the cooling system during docking by providing self-centering alignment as the portable cooler is lowered onto the support surface.

5. The hybrid cooler arrangement according to claim 1, wherein the portable cooler is devoid of any built-in refrigeration components including compressors, condensers, evaporators, refrigerant circuits, thermoelectric cooling elements, and powered cooling fans, such that the portable cooler contains only passive insulation and no active cooling capability when detached from the cooling system, and wherein the portable cooler has a weight of less than 15 pounds when empty, facilitating manual carrying by a user.

6. The hybrid cooler arrangement of claim 1, wherein the male extension is tapered to allow for circulation of cooling air from the cooling system, to the cooling compartment of the cooler, and back to the cooling system.

7. The hybrid cooler arrangement of claim 6, wherein the plug member is held in the second position by a plurality of magnets.

8. The hybrid cooler arrangement of claim 1, wherein a nose portion of the cooling system includes a seal preventing leakage of air between the portable cooler and the cooling system when the portable cooler is docked with the cooling system.

9. The hybrid cooler arrangement of claim 1, wherein the cooling system includes one or more magnets for engaging a shell of the portable cooler to hold the portable cooler securely relative to the cooling system.

* * * * *